US005161477A

United States Patent [19]

Lindqvist

[11] Patent Number: 5,161,477

[45] Date of Patent: Nov. 10, 1992

[54] ICE GOING SHIP

[75] Inventor: Gustav Lindqvist, Esbo, Finland

[73] Assignee: Masa-Yards Oy, Helsinki, Finland

[21] Appl. No.: 579,887

[22] Filed: Sep. 7, 1990

[30] Foreign Application Priority Data

Sep. 13, 1989 [FI] Finland ..... 894318

[51] Int. Cl.[5] ..... B63B 35/08

[52] U.S. Cl. ..... 114/40; 114/56

[58] Field of Search ..... 114/40, 56, 288, 41, 114/42

[56] References Cited

U.S. PATENT DOCUMENTS 3,530,814 9/1970 Rastorguev et al. ..... 114/40
4,715,305 12/1987 Wilkman et al. ..... 114/40
4,942,837 7/1990 Hellmann et al. ..... 114/40

FOREIGN PATENT DOCUMENTS 757385 8/1980 U.S.S.R. ..... 114/40

*Primary Examiner*—Sherman Basinger
*Assistant Examiner*—Thomas J. Brahan
*Attorney, Agent, or Firm*—Dellett, Smith-Hill and Bedell

[57] ABSTRACT

A ship's hull designed for traffic in icy waters has a general form defining a bottom that is substantially horizontal in longitudinal section and has a central longitudinal keel line, and, at both sides of the bottom, sides that extend upward from the bottom. The bottom of the hull is formed with a depression at each side of the keel line. Each depression has a rear edge oriented obliquely relative to the keel line and extending to the rear of the hull from an inner location close to the keel line to an outer location farther from the keel line and at which the depression is open towards one side of the hull. The rear edge of each depression forms a substantially vertical guide surface for ice chunks under the hull's bottom.

15 Claims, 2 Drawing Sheets

ICE GOING SHIP

BACKGROUND OF THE INVENTION

This invention relates to a ship intended for traffic in icy waters and to a hull for such a ship.

An important parameter in the design of a ship intended for traffic in ice-filled waters is the maximum thickness of level ice to be broken by the ship. This parameter affects at least the following design decisions, namely, hull plating thickness, particularly for the bow portion of the hull (the bow plating is typically 30 mm for ice 1 m thick, 40 mm for ice 1.5 m thick and 50 mm for ice thicker than 1.5 m); bow form (a rounded-off form is preferable for thicker ice); stem angle (the thicker the ice, the greater the inclination of the stem); and rudder position (the thicker the ice, the greater the depth of the rudder below the design waterline plane).

As a ship moves through an ice field, the ice is broken into chunks and chunks in front of the ship are forced below the surface of the water by the ship's forward movement. The chunks of ice then slide along the external surface of the underwater part of the hull. Some of the chunks of ice slide along the bottom surface of the hull, thereby easily coming in contact with the ship's propeller, which reduces propeller efficiency.

A considerable portion of the resistance to movement encountered by an ice breaking ship in icy waters is due to friction between the ship's hull and the chunks of broken ice sliding along the underwater part of the hull. This friction may be decreased by directing ice chunks so that they move away from the traffic channel formed by breaking the ice and pass under the adjacent edges of the unbroken ice. At the same time, the advantage is obtained that the ice chunks are kept away from the propellers of the ship, which improves the efficiency of the propellers. In addition, the passage of ships following the ice breaking ship is facilitated.

The size of the ice chunks formed when a ship traverses an ice field depends largely on the bow form. The size of a chunk refers to the average linear dimension of the chunk in the plane of the ice. The dimension is usually fairly uniform in all horizontal directions, since ice chunks seldom have a distinctly elongated form. It will be appreciated that the total energy used in breaking ice is in most cases inversely related to the size of the chunks. One explanation for this is that formation of a few large chunks implies that the total length of fractures in the ice is smaller than if many small chunks are formed. Therefore, the size of the ice chunks is an important parameter in the design of a ship for use in icy water. In terms of ice-breaking efficiency, therefore, it is desirable to design a ship to form large chunks by bending the ice downwards. However, a bow form that is favorable for ice breaking is generally unfavorable with respect to its resistance to forward movement in open water, and, therefore, a compromise must be made based on the proportion of time that the ship is expected to be operating in icy water.

Several different ship hull forms have been suggested for directing ice chunks away from under the bottom of a ship. U.S. Pat. No. 4,715,305 discloses a vessel whose bottom includes a step-formed plow structure diverging in a rearward direction. Disadvantages of a hull provided with such a plow structure are that it is expensive to build and, in comparison with a conventional ship hull, is less seaworthy and has a greater resistance to movement in open water. The plow structure also increases the draft of the vessel and reduces its displacement in relation to its draft.

Another way of directing ice chunks away from under the bottom of a ship is shown in German Application Publication DE 2112334, according to which vertically projecting plow elements are fitted to the bottom of the ship. This structure gives a relatively good sideways transport of ice chunks, but it considerably increases the vessel's draft and resistance to forward movement. It also causes problems when the ship is to be docked. In addition, a relatively strong turbulent water flow occurs under the lower edge of the plow and this tends to suck ice chunks in under the bottom of the ship and defeat the purpose of the plow.

U.S. Pat. No. 4,702,187 shows a plow structure that is foldable into a recess in the bottom of the ship. When the plow is in its folded position, the resistance to forward movement in free water is smaller, the ship is more seaworthy, its steering is more easy and the draft of the ship is not greater than that of a ship without a plow structure. Further, when the apex of the plow is open or the rear side of the plow is inclined towards the bottom of the ship, the undesirable turbulent flow under the bottom edge of the plow is decreased. Disadvantages of the foldable plow include the practical problems related to moving structures submerged in water, and strength problems, because a large load is applied to the plow by the ice chunks.

SUMMARY OF THE INVENTION

The invention may be used to provide a new and more economical arrangement for guiding broken ice chunks sideways away from under the bottom of an ice breaking ship. In such an arrangement, factors impairing the seaworthiness and increasing the resistance to forward movement of the ship are reduced to a minimum. The plow structure has a minimal harmful influence on the ship's displacement/draft ratio.

In accordance with the present invention, a ship's hull designed for traffic in icy waters has a general form defining a bottom that is substantially horizontal in longitudinal section and has a central longitudinal keel line, and, at both sides of the bottom, sides that extend upward from the bottom. The bottom of the hull is formed with a depression at each side of the keel line. Each depression has a rear edge oriented obliquely relative to the keel line and extending to the rear of the hull from an inner location close to the keel line to an outer location farther from the keel line and at which the depression is open towards one side of the hull. The rear edge of the depression forms a substantially vertical guide surface for ice chunks under the hull's bottom.

The rear edges of the depressions form a plow structure, which guides ice chunks sideways. Nevertheless, the bottom form of the hull is such that docking of a ship built on the hull does not cause considerable difficulties, and the bottom form does not substantially reduce the displacement, or useful volume, of the ship in relation to its draft.

Since only the rear edge of the depression is important for guiding ice chunks, the depression may be so formed that the depth of the depression is zero at its front edge and increases uniformly in a direction towards the rear edge of the depression, where it reaches its maximum. In this way, the harmful influence of the plow structure on the resistance to forward movement of the ship and on the displacement/draft ratio of the ship can be minimized because the plow structure does not project below the bottom of the hull. If, in addition, the main surface of the depression, that is its bottom, has a plane surface, the most easily-built solution is obtained.

Because a depression in the bottom of a ship's hull has an unfavorable influence on the displacement of the ship, it is desirable that the volume of the depression be as small as possible. In determining the dimensions of the depression, the ice conditions for which the ship is designed must be observed. The maximum thickness of level ice to be broken and the normal size of the broken ice chunks are taken into account when determining the dimensions of the bottom depressions, preferably so that the width of the elongated depression substantially corresponds to the size of the ice chunks broken by the ship in level ice and so that the verticle height of the ice guiding surface is 0.1–0.2 times the maximum thickness of level ice to be broken.

It has been established that the plow structure of a ship's hull embodying the invention functions more effectively the closer it is to the rear of the hull. Nevertheless, the plow structure should be in the bottom portion, that is the portion that is horizontal seen from the side. It has also been established that the best region for the bottom depressions is a region having its front limit at least 20%, preferably at least 30%, of the waterline length of the ship from the front end of the waterline plane of the ship. The term "the waterline plane of the ship" means a longitudinal section of the hull in the plane determined by the design waterline of the ship. The rear end of the bottom depressions is preferably close to the rear end of the horizontal bottom portion of the hull.

If the ship is very long, a plurality of depressions may be arranged one after another, at each side of the keel line of the ship. In this manner, a more effective sideways transport of ice chunks is obtained. The rear edge of each depression aft of the forward depression preferably has a slightly greater vertical dimension than the rear edge of the depression immediately in front.

The direction of the guide surface for the ice chunks is important. If the guide surface is at too large an angle to the keel line of the ship, the resistance to forward movement of the ship is high and the guiding of the ice chunks is not the most favorable. The best results are obtained if the guide surface for the ice chunks is at an angle no greater than 30°, preferably no greater than 25°, to the keel line of the ship. This refers to the angle of the guide surface of the ice chunks at a position where its direction has its maximum deviation from the keel line direction. This position is normally very close to the side edge of the bottom of the ship. Closer to the keel line, the angle of the guide surface to the keel line is preferably considerably smaller, and may be 0° close to the keel line and continuously increase in a direction towards the side edge of the bottom of the ship.

Docking of the ship is facilitated if a narrow flat portion is left in the bottom between the bottom depressions, the width of the flat portion being for instance 3–10% of the total width of the ship.

BRIEF DESCRIPTION OF THE DRAWINGS

In the following, the invention will be described in greater detail with reference to the accompanying drawings, in which.

DETAILED DESCRIPTION

Figure 1:
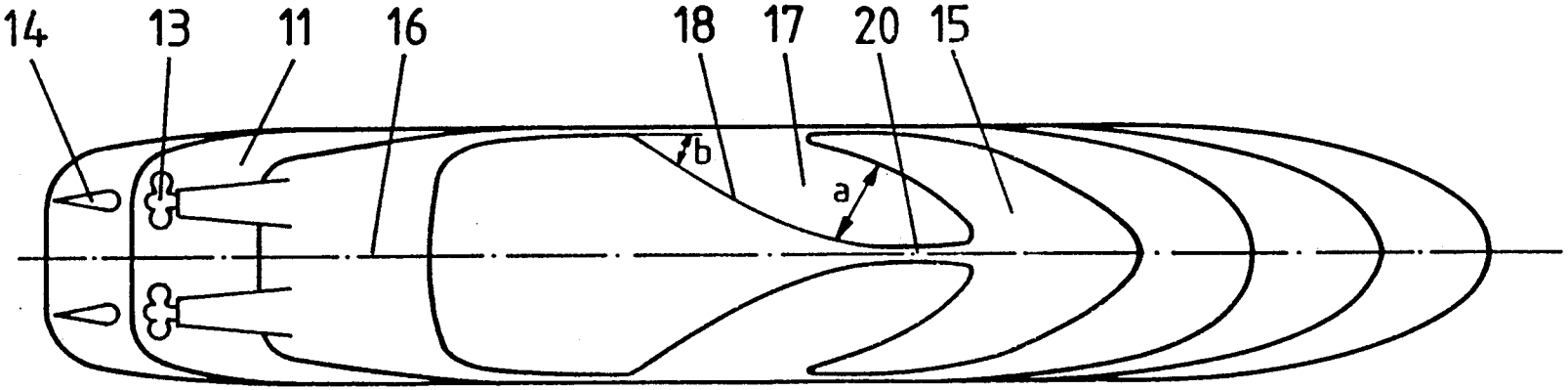
FIG. 1 is a schematic bottom view of a ship according to the invention.
Figure 2:
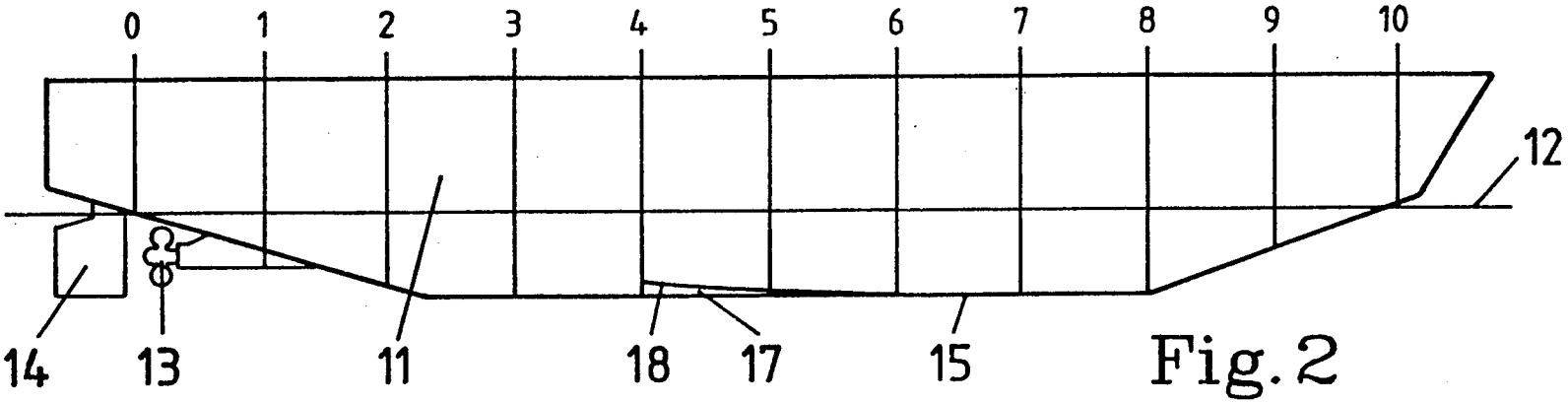
FIG. 2 is a side view of the ship of FIG. 1.

In FIGS. 1 and 2, 11 indicates the hull of a ship and 12 the design waterline of the ship. The waterline length is in FIG. 2 divided into ten segments of equal length defined between adjacent planes numbered 0–10. The front end of the waterline of the ship is at plane 10 and the rear end is at plane 0. In addition, the ship's propellers 13 and rudders 14 are schematically shown.

As shown in FIG. 2, the ship has a bottom 15 which is generally horizontal seen from the side and starts at plane 8 and ends slightly in front of plane 2. Into this horizontal bottom, elongated depressions 17 have been made symmetrically at both sides of the longitudinal axis or keel line 16 of the ship. The rear edge 18 of each depression 17 forms a vertical guide surface for ice chunks. Ice chunks entering a depression 17 run into the guide surface 18 and slide along this surface towards the side edge of the bottom of the ship where the sideways forced ice chunks continue their movement away from the keel line 16 due to their own momentum.

As evident from FIG. 2, the depression 17 is wedge-formed and its bottom is a plane surface. The depressions 17 are entirely within an area having its front limit more than 30% of the waterline length of the ship from the front end of the waterline plane of the ship, that is, aft of plane 7. Between the depressions 17, there is a flat portion 20, preferably having a width that is 3–10% of the total width of the ship. The depressions 17 do not extend into the flat portion 20.

The depth of the depression 17 is preferably 0.1–0.2 times the maximum thickness of level ice to be broken, considered as a design parameter of the ship. The width a of the depression measured perpendicular to the rear edge substantially corresponds to the size of the ice chunks formed by the ship in level ice. The angle b of the ice chunk guide surface 18 relative to the longitudinal direction of the ship is about 25° close to the sides of the hull, where it reaches its maximum.

It can be seen that the angle of the guide surface 18 to the keel line increased from a small value close to the keel line to the value b close to the side of the hull.

Figure 3:
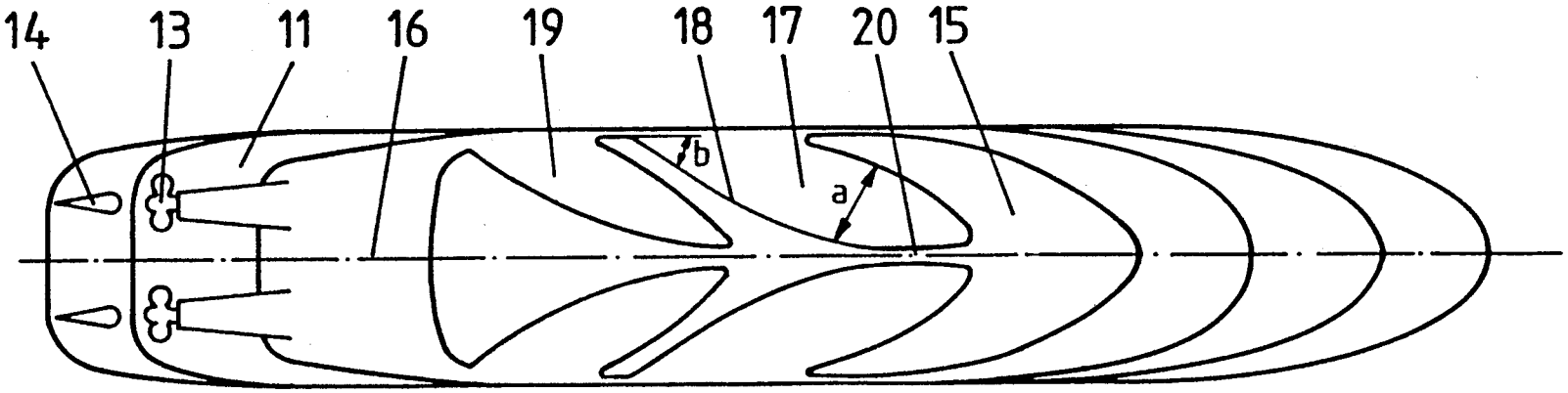
FIG. 3 is a schematic bottom view of a second ship according to the invention.
Figure 4:
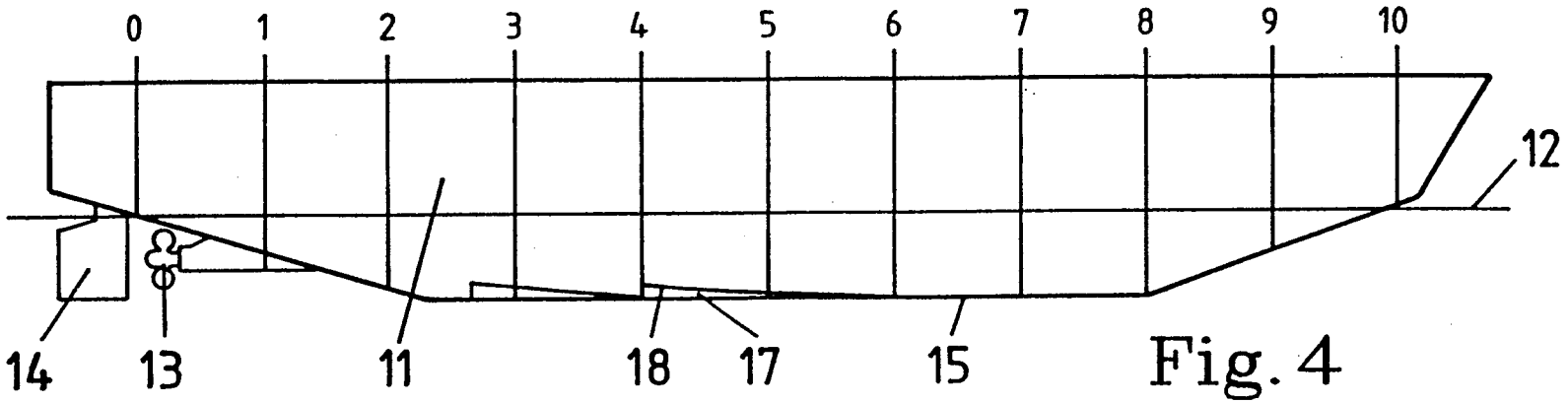
FIG. 4 is a side view of the ship of FIG. 3.

FIGS. 3 and 4 show an alternate construction in which two depressions 17 and 19 are arranged one after another at each side of the keel line 16 of the ship. The rear depressions 19 are very close to the rear limit of the horizontal bottom 15 of the ship.

It will be appreciated that the invention is not restricted to the particular embodiment that has been described and illustrated, and that variations may be made therein without departing from the scope of the invention as defined in the appended claims and equivalents thereof. For example, although the ship shown in FIGS. 1 and 2 has a bottom that is horizontal (but for the depressions) in transverse section, the invention is also applicable to a ship in which the bottom is generally V-shaped in transverse section, as shown in U.S. Pat. No. 4,781,135. Furthermore, although it is preferred that two depressions on opposite sides of the keel line be at the same positions along the hull, so that the guide surfaces form a V-shaped plow extending across the bottom of the hull (except possibly for the flat portion 20), the depressions on opposite sides of the keel line could be staggered so that the guide surfaces are spaced apart along the hull.

I claim:

1. A ship's hull designed for traffic in icy waters, said hull having a general form defining a bottom that is substantially horizontal in longitudinal section and has a central longitudinal keel line, and, at both sides of the bottom, sides that extend upward from the bottom the bottom of the hull being formed with at least one depression at each side of the keel line, each depression having a rear edge oriented obliquely relative to the keel line and extending to the rear of the hull from an inner location close to the keel line to an outer location farther from the keel line and at which the depression is open towards one side of the hull, the rear edge of the depression forming a substantially vertical guide surface for ice chunks under the hull's bottom, and wherein the hull's bottom has a forward portion that is forward of the depressions and is substantially horizontal in longitudinal section and a rear portion that is to the rear of the depressions and is substantially horizontal in longitudinal section and is substantially coplanar with the forward portion of the hull's bottom.

2. A hull according to claim 1, wherein the vertical height of the depression continuously decreases from said rear edge in a forward direction of the ship.

3. A hull according to claim 2, wherein the depression is bounded over at least the major part of its area by a plane surface.

4. A hull according to claim 1, wherein the depression has a width, measured perpendicular to its rear edge, substantially corresponding to the typical size of ice chunks broken by the hull during advancement through level ice.

5. A hull according to claim 1, wherein the rear edge of the depression forms an angle with the keel line of up to 30°.

6. A hull according to claim 1, wherein the rear edge of the depression forms an angle with the keel line of up to 25°.

7. A hull according to claim 1, wherein the depressions are spaced apart along the lateral dimension of the hull by a portion of the bottom of the hull that is substantially horizontal, whereby the keel line is essentially straight from a point forward of the depressions to a point after the depressions.

8. A hull according to claim 7, wherein the minimum lateral spacing between the depressions is about three-ten percent of the total width of the hull.

9. A ship's hull designed for traffic in icy waters, said hull having a general form defining a bottom that is substantially horizontal in longitudinal section and has a central longitudinal keel line, and, at both sides of the bottom, sides that extend upward from the bottom, the bottom of the hull being formed with a plurality of depressions, one after another, at each side of the keel line, each depression having a rear edge oriented obliquely relative to the keel line and extending to the rear of the hull from an inner location close to the keel line to an

10. A hull according to claim 9, wherein the rearmost depression at each side of the keel line is close to the rearmost portion of the substantially horizontal bottom portion.

11. A hull according to claim 9, wherein the hull's bottom has a forward portion that is forward of the depressions and is substantially horizontal in longitudinal section and a rear portion that is to the rear of the depressions and is substantially horizontal in longitudinal section and is substantially coplanar with the forward portion of the hull's bottom.

12. A ship designed for traffic in icy waters, said ship having a hull with a general form defining a bottom that is substantially horizontal in longitudinal section and has a central longitudinal keel line, and, at both sides of the bottom, sides that extend upward from the bottom, the bottom of the hull being formed with at least one depression at each side of the keel line, each depression having a rear edge oriented obliquely relative to the keel line and extending to the rear of the hull from an inner location close to the keel line to an outer location father from the keel line and at which the depression opens towards one side of the hull, the rear side of the depression forming a substantially vertical guide surface for ice chunks under the hull's bottom, and wherein the hull's bottom has a forward portion that is forward of the depressions and is substantially horizontal in longitudinal section and a rear portion that is to the rear of the depressions and is substantially horizontal in longitudinal section and is substantially coplanar with the forward portion of the hull's bottom.

13. A ship according to claim 12, wherein the rear edge of the depression has a maximum vertical height of 0.1–0.2 times the maximum thickness of level ice to be broken by the ship.

14. A ship according to claim 12, wherein the depression is located within an area having its front limit at least 20% of the design waterline length of the ship aft of the forward end of the waterline of the ship.

15. A ship according to claim 12, wherein the depression is located within an area having its front limit at least 30% of the design waterline length of the ship aft of the forward end of the waterline of the ship.

* * * * *